US011143388B2

(12) United States Patent
Ji et al.

(10) Patent No.: US 11,143,388 B2
(45) Date of Patent: Oct. 12, 2021

(54) LIGHTING LAMP

(71) Applicants: Self Electronics Co., Ltd., Zhejiang (CN); Wanjiong Lin, Zhejiang (CN); Self electronics USA Corporation, Norcross, GA (US)

(72) Inventors: Feng Ji, Zhejiang (CN); Zhaoyong Zheng, Zhejiang (CN); Huangfeng Pan, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/916,072

(22) Filed: Jun. 29, 2020

(65) Prior Publication Data

US 2021/0088201 A1 Mar. 25, 2021

(30) Foreign Application Priority Data

Sep. 23, 2019 (CN) ..... 201910896797.0

(51) Int. Cl.

| | |
|---|---|
| ***F21V 19/00*** | (2006.01) |
| ***F21S 4/28*** | (2016.01) |
| ***F21V 3/02*** | (2006.01) |
| ***F21V 5/04*** | (2006.01) |
| ***F21V 7/00*** | (2006.01) |
| *F21Y 103/10* | (2016.01) |
| *F21Y 115/10* | (2016.01) |

(52) U.S. Cl.

CPC ..... *F21V 19/003* (2013.01); *F21S 4/28* (2016.01); *F21V 3/02* (2013.01); *F21V 5/04* (2013.01); *F21V 7/005* (2013.01); *F21Y 2103/10* (2016.08); *F21Y 2115/10* (2016.08)

(58) Field of Classification Search

CPC . F21V 19/003; F21V 3/02; F21V 5/04; F21V 7/005; F21V 5/043; F21V 19/0035; F21V 17/164; F21V 15/013; F21V 7/22; F21V 5/002; F21V 31/00; F21V 13/00; F21V 13/02; F21V 13/04; F21V 13/12; F21S 4/28; F21Y 2103/10; F21Y 2115/10

See application file for complete search history.

(56) References Cited

U.S. PATENT DOCUMENTS

| | | | | |
|---|---|---|---|---|
| 7,104,672 | B2 * | 9/2006 | Zhang | G02B 5/1861 362/308 |
| 2013/0033859 | A1 * | 2/2013 | Yaphe | F21V 13/04 362/223 |
| 2017/0370539 | A1 * | 12/2017 | Xu | F21S 4/28 |

* cited by examiner

*Primary Examiner* — Bao Q Truong

(74) *Attorney, Agent, or Firm* — Wang Law Firm, Inc.

(57) ABSTRACT

A lighting lamp has a lamp body and an end cover assembly, the lamp body includes a strip lamp holder, a circuit board, a light source, a optical lens and two reflecting barriers; the reflecting barriers and the optical lens are integrally formed, and the bottom of the reflecting barriers presses the top surface of the circuit board when the optical lens is fixedly connected to the strip lamp holder. The present invention has a simple and compact structure, and is easy to assemble, the assembly process takes up less space, and is more suitable for automated production.

15 Claims, 6 Drawing Sheets

LIGHTING LAMP

RELATED APPLICATION

This application claims priority to a Chinese Patent Application No. CN 201910896797.0, filed on Sep. 23, 2019.

FIELD OF THE TECHNOLOGY

The present invention relates to the field of lighting technology, with particular emphasis on a lighting lamp.

BACKGROUND OF THE INVENTION

In the context of energy saving and environmental protection, LED lamps are increasingly used in the field of home and commercial lighting because of their high light extraction efficiency and good light collection performance.

When assembling LED lamps, the lamp holder, circuit board and optical elements need to be fixed together. When the circuit board is mounted on the lamp holder, it is generally required to be fixed by bonding or locking, resulting in complicated assembly steps, increasing installation costs and not conducive to automated production.

BRIEF SUMMARY OF THE INVENTION

In view of this, the present invention provides a lighting lamp to solve the above technical problems.

A lighting lamp, comprising a lamp body and an end cover assembly, the lamp body comprises:

strip lamp holder, provided with a mounting cavity extending in the length direction, and a light exit port is provided on the top surface of the installation cavity;

circuit board, disposed in the mounting cavity, and the top surface faces the light exit port, and the mounting cavity limits the bottom surface and both sides of the circuit board;

light source, arranged on the top surface of the circuit board;

optical lens fixedly connected to the strip lamp holder and encapsulates the light exit port;

two reflecting barrier, arranged in the mounting cavity and respectively located on both sides of the light source in the width direction for reflecting the large-angle light rays from the light source onto the optical lens;

the reflecting barriers and the optical lens are integrally formed, and the bottom of the reflecting barriers presses the top surface of the circuit board when the optical lens is fixedly connected to the strip lamp holder.

the optical lens and the strip lamp holder are fixedly connected by a buckle structure.

both sides of the strip lamp holder in the width direction are provided with inwardly turned convex edges, the outer side of the reflecting barriers is provided with a clamping slot that cooperates with the convex edge.

the upper surface of the convex edge is inclined downward from the outside to the inside.

the outer side surface of the lower slot edge of the clamping slot is an arc-shaped surface.

The lighting lamp further comprising a light diffusing film, the light diffusing film is disposed in the light output direction of the light source and is located between the optical lens and the reflective barriers for stretching the light from the light source along the length direction.

a film clamping slot is provided on the inner side of the optical lens.

an elastic member is provided at the bottom end of the reflecting barrier.

the elastic member is a rubber strip extending along the length direction.

the end cover assembly comprises an end cover body, and the end cover body is provided with two connector clips which are inserted on both sides of the mounting cavity, and the outer surface of the strip lamp holder is provided with a stamping area corresponding to the connector clips.

Technical Effect of the Invention

The lighting lamp of the present invention has a simple and compact structure, is easy to assemble, occupies less space during the assembly process, and is more convenient for automated production.

BRIEF DESCRIPTION OF THE DRAWINGS

The following describes embodiments of the present invention with reference to the accompanying drawings, in which.

DETAILED DESCRIPTION OF THE INVENTION

Figure 1:
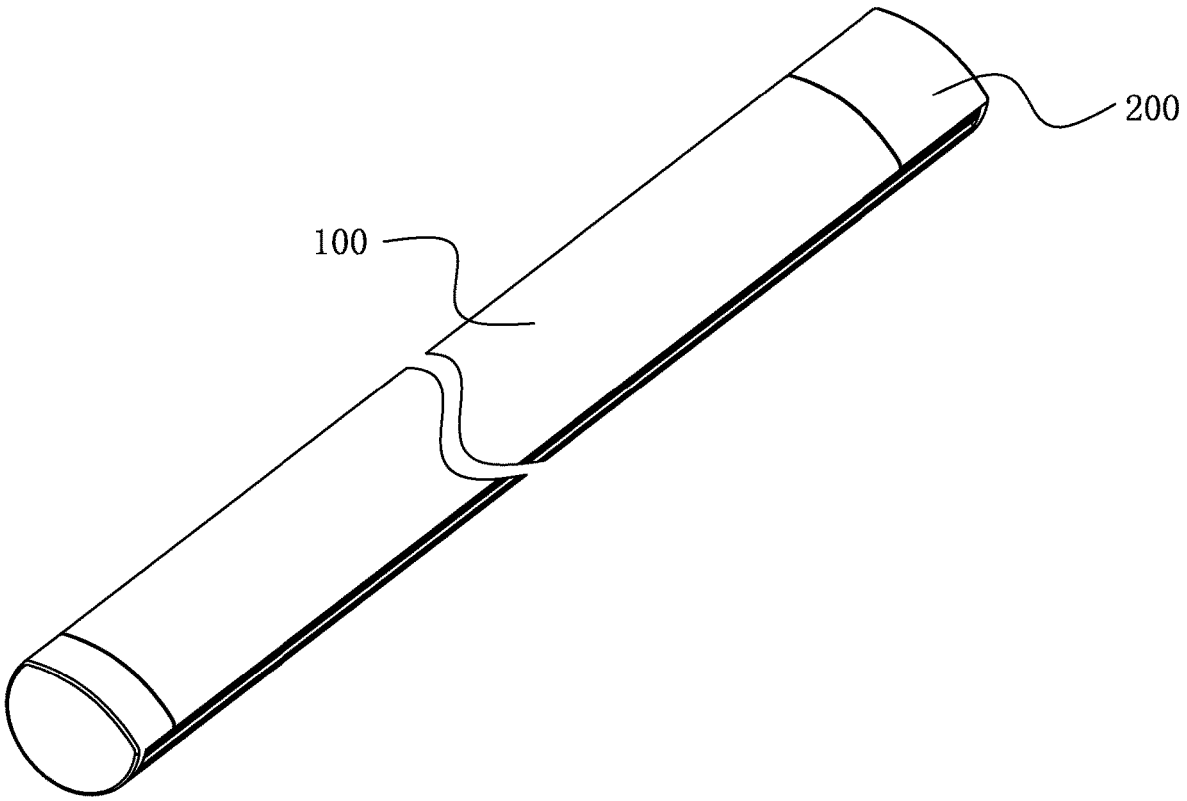
FIG. 1 is a schematic structural diagram of the lighting lamp of embodiment 1.
Figure 2:
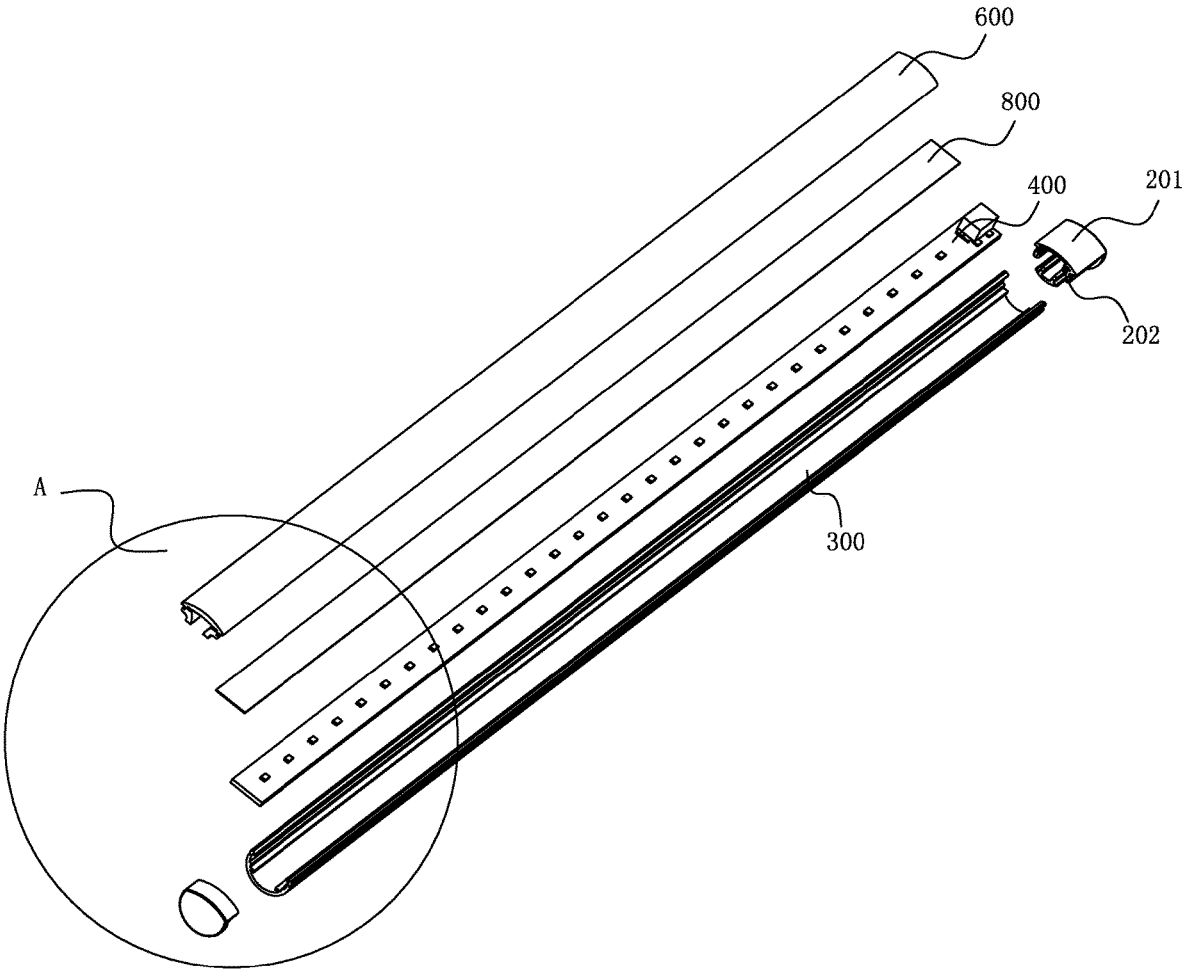
FIG. 2 is an exploded schematic view of the lighting lamp of embodiment 1.
Figure 3:
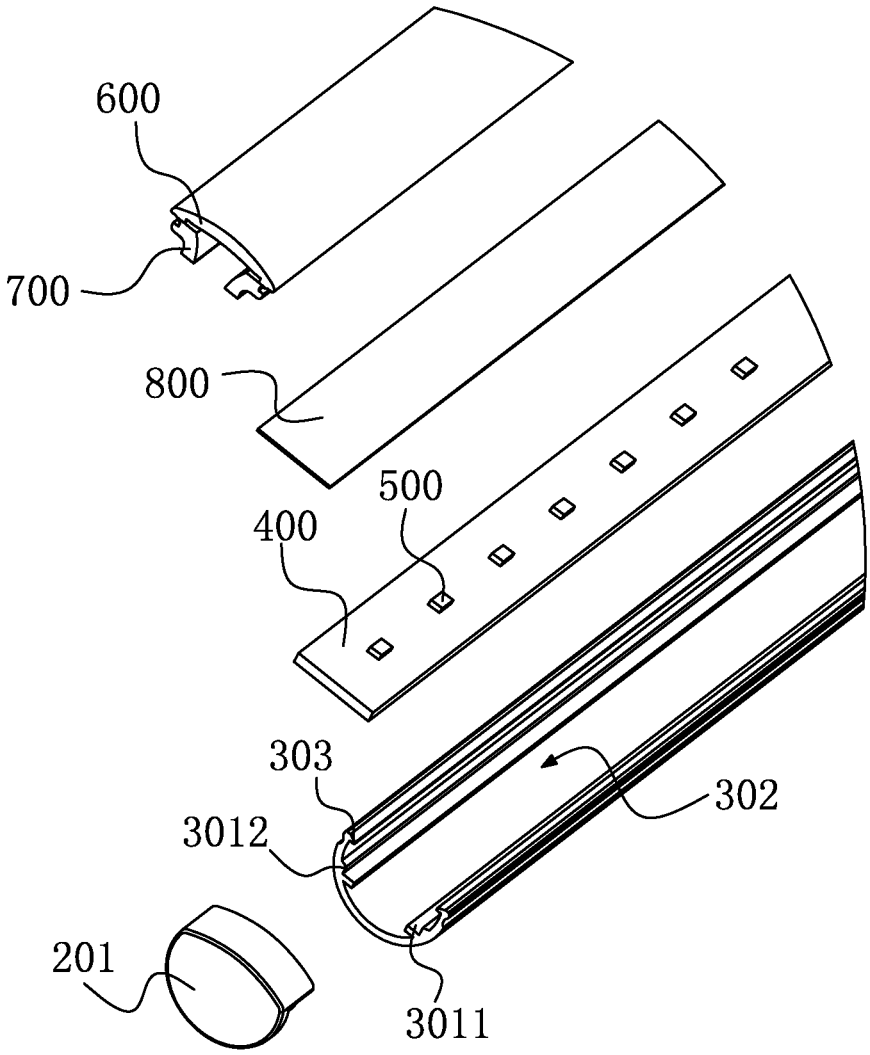
FIG. 3 is an enlarged schematic view of part A in FIG. 2.
Figure 4:
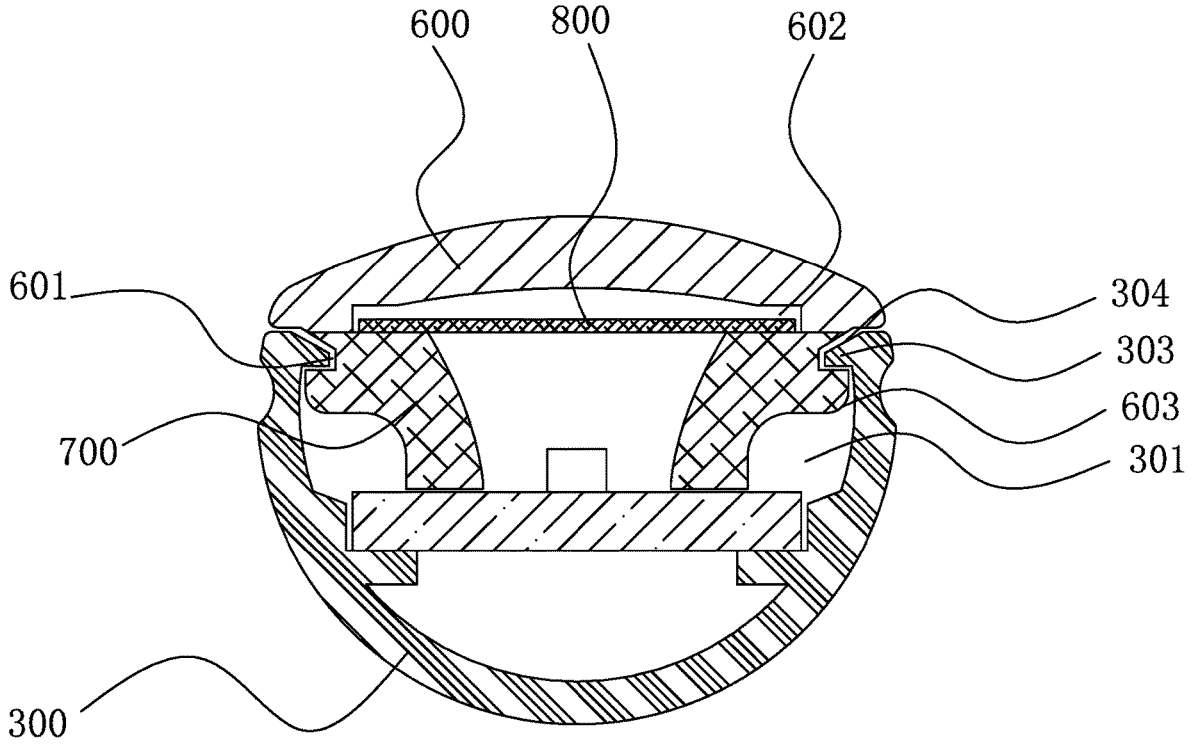
FIG. 4 is a schematic cross-sectional view of the cross section of the lamp body of the lighting lamp of embodiment 1.
Figure 5:
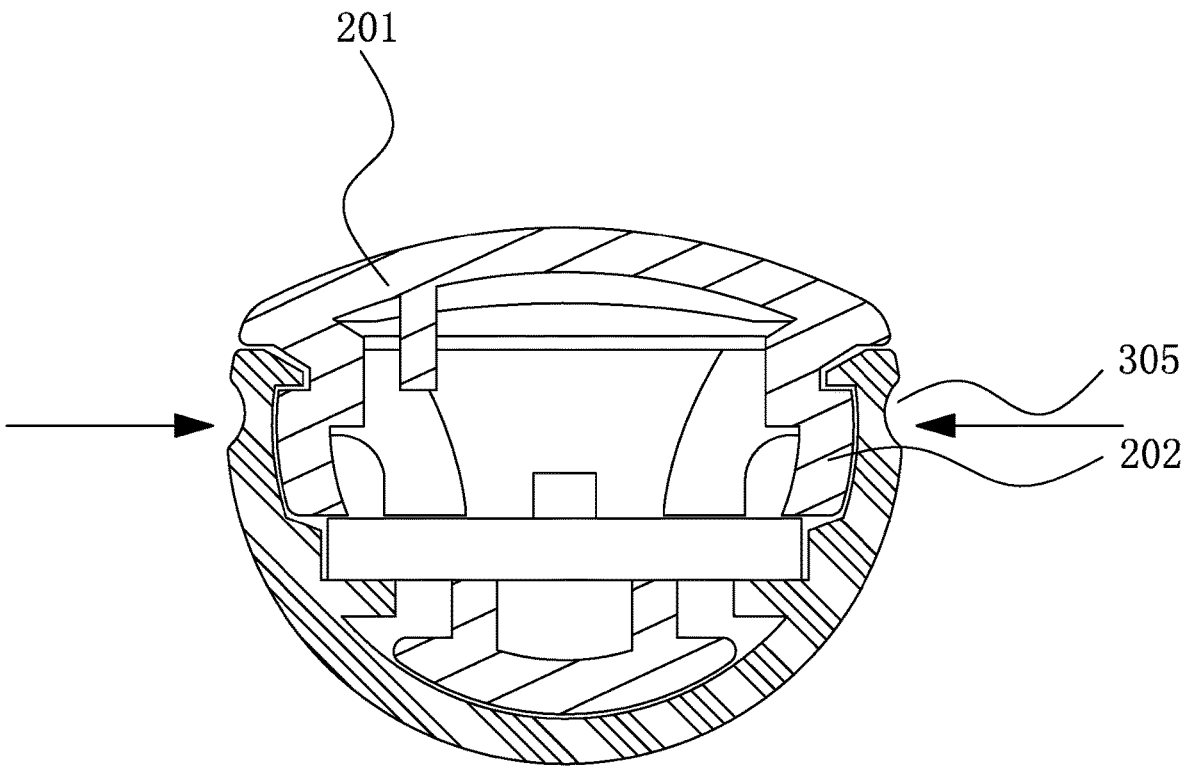
FIG. 5 is a schematic cross-sectional view of the cross section of the end cover assembly of the lighting lamp of embodiment 1.

Hereinafter, specific embodiments of the present invention will be described in further detail based on the drawings. It should be understood that the description of the embodiments of the present invention is not intended to limit the protection scope of the present invention.

As shown in FIG. 1 to 5, the lighting lamp of this embodiment includes a lamp body 100 and an end cover assembly 200. The lamp body 200 includes a strip lamp holder 300, a circuit board 400, a light source 500, an optical lens 600 and two reflective walls 700.

The strip lamp holder 300 is provided with a mounting cavity 301 extending in the length direction, and a light outlet 302 is formed on the top surface of the mounting cavity 301. The strip lamp holder 300 is used to support and install other parts, play the role of protection and heat dissipation, generally using aluminum alloy and other metal materials.

The lighting lamp has a longitudinal direction, that is, an axial direction, a light outlet direction is defined as a height direction, and a direction vertical to height direction is a width direction. In this embodiment, the surface on which the light source is mounted on the circuit board is also defined as the top surface, and the light outlet direction is upward.

The circuit board 400 is disposed in the mounting cavity 301 with the top surface facing the light outlet 302, and the mounting cavity 301 limits the bottom surface and both sides of the circuit board 400; it can realize that the mounting cavity 301 limits the bottom surface and both sides of the circuit board 400 by setting the support base 3011 and the limiting side 3012. The top surface of the circuit board 400 is not limited. Therefore, the circuit board 400 can be inserted into the mounting cavity 301 from the end, or it can be placed into the mounting cavity 301 from the light outlet 302 from top to bottom, so that the requirement for installation space can be greatly reduced.

The light source 500 is disposed on the top surface of the circuit board 400. The light source 500 can be set to one or more, arranged at intervals along the length direction of the circuit board 400. In the context of energy saving and environmental protection, LED lamps are increasingly used in the field of home and commercial lighting due to their high light extraction efficiency and good light collection performance. The light source 500 uses LED chips.

The optical lens 600 is fixedly connected to the strip lamp holder 300 and encapsulates the light outlet 302, and the optical lens 600 has the function of focusing and dimming light.

The two reflecting barriers 700 are disposed in the mounting cavity 301 and are respectively located on both sides of the light source 500 in the width direction for reflecting the large-angle light rays from the light source 500 onto the optical lens 600. Large-angle light rays and small-angle light rays are defined according to the angle at which the light rays deviate from the center line of the light source.

The reflecting barriers 700 and the optical lens 600 are integrally formed and manufactured. When the optical lens 600 is fixedly connected to the strip lamp holder 300, the bottom end of the reflecting barriers 700 presses the top surface of the circuit board 400.

The reflecting barriers 700 is formed integrally with the optical lens 600. The light source 500 is disposed on the circuit board 400. Most of the light is emitted in the direction of optical lens 600, but a small part of the lateral light is deviated from the main beam and directed to other directions. However, this kind of light is often not utilized, which reduces the effective utilization rate of light. This is a common problem in which the light sources radiate. When the above design is adopted, it can make good use of the reflection effect to direct the originally deviated lateral light rays to the optical lens 600, so as to concentrate the light beam. More luminous flux per unit area is actually diffused by optical lens 600, so as to improve the effective utilization of light, reduce the number of light source 500 and reduce the cost. At the same time, in this embodiment, when the optical lens 600 is fixedly connected to the strip lamp holder 300, the circuit board 400 is fixed by pressing the bottom end of the reflecting barriers 700 against the top surface of the circuit board 400, avoiding the use of locking parts or glue, which not only simplifies the structure but also makes assembly more convenient.

The reflecting barriers 700 is provided with a reflective layer on the inner wall to achieve the light-reflecting effect. In this embodiment, for ease of manufacturing, the reflecting barriers 700 is the same material as the optical lens 600, and a white diffusing agent is provided on the reflecting barriers 700 to reflect the light. The reflecting barriers 700 and the optical lens 600 are integrally formed by two-color extrusion.

In order to further simplify the structure, the optical lens 600 and the strip lamp holder 300 are fixedly connected by a buckle structure. There are many forms of buckle connection, which are generally realized in the form of groove cooperation. In order to make the appearance more beautiful, in this embodiment, the two sides of the strip lamp holder 300 are provided with inwardly turned convex edges 303 in the width direction, the outer side of the reflecting barriers 700 is provided with a clamping slot 601 that cooperates with the convex edge 303. Therefore, the optical lens 600 can be fitted to the edge of the strip lamp holder 300 outside the installation cavity 301 to improve the appearance.

In order to make the assembly more convenient, in this embodiment, the upper surface 304 of the convex edge 303 is inclined downward from the outside to the inside, and the optical lens 600 is installed from top to bottom, and the outer side of the lower groove edge of the clamping slot 601 is in contact with the upper surface 304, Under the action of the component force, the strip lamp holder 300 expands to assemble the clamping slot 601 and the convex edge 303. It is further preferred that the outer side face 603 of the lower slot edge of the clamping slot 601 is an arc-shaped surface.

In this embodiment, a light diffusing film 800 is also provided. The light diffusing film 800 is disposed in the light output direction of the light source 500 and is located between the optical lens 600 and the reflecting barriers 700 for stretching the light from the light source 500 along the length direction. In order to facilitate installation, the inside of the optical lens 600 is provided with a film slot 602.

In order to further simplify the structure, in this embodiment, the end cover assembly 200 includes an end cover body 201, and the end cover assembly 200 may further include some other components, such as dust plugs, etc., which will not be repeated here. The end cover body 201 is provided with two connector clips 202 which are inserted on both sides of the mounting cavity 301, and the outer surface of the strip lamp holder 300 is provided with a stamping area 305 corresponding to the connector clips 202. The end cover body 201 is fixed by stamping the stamping areas 305 on both sides of the strip lamp holder 300 in the radial direction (direction indicated by the arrow in FIG. 5), which reduces the number of locking parts and makes the structure more compact.

The outer surface of the strip lamp holder 300 is generally an arc-shaped surface, and it would be offset when stamping directly. In this embodiment, the stamping area 305 is provided with an arc-shaped depression to make the stamping more accurate and avoid deviation.

Figure 6:
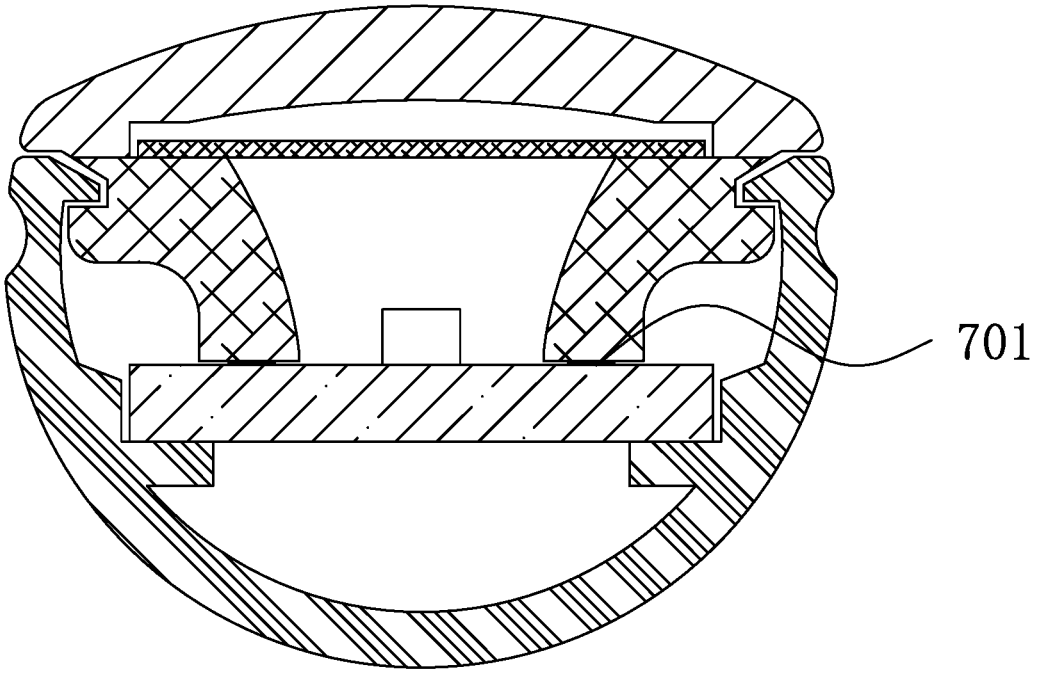
FIG. 6 is a schematic cross-sectional view of the cross section of the lamp body of the lighting lamp of embodiment 2.

As shown in FIG. 6, the present invention also provides an embodiment. In order to improve the fixing effect, an elastic member 701 is provided at the bottom end of the reflecting barriers 700. The setting of the elastic member 701 can make a certain assembly gap between the reflecting barriers 700 and the circuit board 400, so as to avoid uneven pressure damage to the circuit board 400. To facilitate manufacturing, the elastic member 701 is a rubber strip extending along the length direction, and can be manufactured by co-extrusion molding.

In summary, the lighting lamp of this embodiment has a simple structure, is easy to assemble and takes up little space, and is particularly suitable for automated assembly.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A lighting lamp, comprising a lamp body (100) and an end cover assembly (200), the lamp body (200) comprising:

strip lamp holder (300), provided with an mounting cavity (301) extending in the length direction, and a light exit port (302) is provided on a top surface of the installation cavity (301);

circuit board (400), disposed in the mounting cavity (301), and a top surface of the circuit board (400) faces the light exit port (302), and the mounting cavity (301) limits a bottom surface and both sides of the circuit board (400);

light source (500), arranged on the top surface of the circuit board (400);

optical lens (600), fixedly connected to the strip lamp holder (300) and encapsulates the light exit port (302);

two reflecting barriers (700), arranged in the mounting cavity (301) and respectively located on both sides of the light source (500) in the width direction for reflecting the large-angle light rays from the light source (500) onto the optical lens (600);

characterized in that the reflecting barriers (700) and the optical lens (600) are integrally formed, and the bottom of the reflecting barriers (700) presses the top surface of the circuit board (400) when the optical lens (600) is fixedly connected to the strip lamp holder (300).

2. The lighting lamp as claimed in claim 1, wherein the optical lens (600) and the strip lamp holder (300) are fixedly connected by a buckle structure.

3. The lighting lamp as claimed in claim 2, wherein both sides of the strip lamp holder (300) in the width direction are provided with inwardly turned convex edges (303), the outer side of the reflecting barriers (700) is provided with a clamping slot 601) that cooperates with the convex edge (303).

4. The lighting lamp as claimed in claim 3, wherein the upper surface (304) of the convex edge (303) is inclined downward from the outside to the inside.

5. The lighting lamp as claimed in claim 3, wherein the outer side surface (603) of the lower slot edge of the clamping slot (601) is an arc-shaped surface.

6. The lighting lamp as claimed in claim 1, further comprising a light diffusing film (800), the light diffusing film (800) is disposed in the light output direction of the light source (500) and is located between the optical lens (600) and the reflective barriers (700) for stretching the light from the light source (500) along the length direction.

7. The lighting lamp as claimed in claim 6, wherein a film clamping slot (602) is provided on the inner side of the optical lens (600).

8. The lighting lamp as claimed in claim 1, wherein an elastic member (701) is provided at the bottom end of the reflecting barrier (700).

9. The lighting lamp as claimed in claim 8, wherein the elastic member (701) is a rubber strip extending along the length direction.

10. The lighting lamp as claimed in claim 1, wherein the end cover assembly (200) comprises an end cover body (201), and the end cover body (201) is provided with two connector clips (202) which are inserted on both sides of the mounting cavity (301), and the outer surface of the strip lamp holder (300) is provided with a stamping area (305) corresponding to the connector clips (202).

11. The lighting lamp as claimed in claim 3, further comprising a light diffusing film (800), the light diffusing film (800) is disposed in the light output direction of the light source (500) and is located between the optical lens (600) and the reflective barriers (700) for stretching the light from the light source (500) along the length direction.

12. The lighting lamp as claimed in claim 4, further comprising a light diffusing film (800), the light diffusing film (800) is disposed in the light output direction of the light source (500) and is located between the optical lens (600) and the reflective barriers (700) for stretching the light from the light source (500) along the length direction.

13. The lighting lamp as claimed in claim 3, wherein an elastic member (701) is provided at the bottom end of the reflecting barrier (700).

14. The lighting lamp as claimed in claim 3, wherein the end cover assembly (200) comprises an end cover body (201), and the end cover body (201) is provided with two connector clips (202) which are inserted on both sides of the mounting cavity (301), and the outer surface of the strip lamp holder (300) is provided with a stamping area (305) corresponding to the connector clips (202).

15. The lighting lamp as claimed in claim 5, wherein the end cover assembly (200) comprises an end cover body (201), and the end cover body (201) is provided with two connector clips (202) which are inserted on both sides of the mounting cavity (301), and the outer surface of the strip lamp holder (300) is provided with a stamping area (305) corresponding to the connector clips (202).

* * * * *